US009332810B2

(12) United States Patent
Hortnagl

(10) Patent No.: US 9,332,810 B2
(45) Date of Patent: May 10, 2016

(54) BUCKLE

(75) Inventor: Andreas Hortnagl, Fulpmes (AT)

(73) Assignee: ABA Hörtnagl GmbH, Fulpmes (AT)

( * ) Notice: Subject to any disclaimer, the term of this patent is extended or adjusted under 35 U.S.C. 154(b) by 261 days.

(21) Appl. No.: 13/977,809

(22) PCT Filed: Dec. 27, 2011

(86) PCT No.: PCT/AT2011/000518
§ 371 (c)(1),
(2), (4) Date: Jul. 1, 2013

(87) PCT Pub. No.: WO2012/092635
PCT Pub. Date: Jul. 12, 2012

(65) Prior Publication Data

US 2013/0291344 A1 Nov. 7, 2013

(30) Foreign Application Priority Data

Jan. 3, 2011 (AU) ..... A 10/2011

(51) Int. Cl.
*A44B 11/10* (2006.01)

(52) U.S. Cl.
CPC ..... *A44B 11/10* (2013.01); *Y10T 24/4084* (2015.01)

(58) Field of Classification Search
CPC .. A44B 11/10; A44B 11/125; A44B 11/2557; Y10T 24/4084; Y10T 24/4016; Y10T 24/4077; Y10T 24/4736
See application file for complete search history.

(56) References Cited

U.S. PATENT DOCUMENTS

| | | | | |
|---|---|---|---|---|
| 2,754,560 | A | 7/1956 | Warner et al. | |
| 2,852,827 | A | 9/1958 | Arnold | |
| 3,099,055 | A | 7/1963 | Huber | |
| 3,293,713 | A * | 12/1966 | Gaylord | 24/196 |
| 3,328,856 | A * | 7/1967 | Jonas | 24/191 |
| 3,574,342 | A | 4/1971 | Berns | |
| 3,641,630 | A | 2/1972 | Farley | |
| 3,686,715 | A * | 8/1972 | Brodnicki | 24/170 |
| 3,852,855 | A * | 12/1974 | Bengtsson | 24/170 |
| 4,118,833 | A | 10/1978 | Knox et al. | |
| 4,608,735 | A | 9/1986 | Kasai | |
| 4,726,625 | A * | 2/1988 | Bougher | 24/170 |
| 4,809,953 | A | 3/1989 | Kurita et al. | |
| 4,843,688 | A * | 7/1989 | Ikeda | 24/170 |
| 5,058,244 | A * | 10/1991 | Fernandez | 24/170 |
| 5,331,726 | A | 7/1994 | Suh | |
| 6,665,913 | B2 * | 12/2003 | Kosh et al. | 24/170 |

(Continued)

FOREIGN PATENT DOCUMENTS

| | | |
|---|---|---|
| AT | 4661472 | 3/1974 |
| AT | 506290 | 8/2009 |

(Continued)

*Primary Examiner* — Robert J Sandy
(74) *Attorney, Agent, or Firm* — Volpe and Koenig, P.C.

(57) ABSTRACT

A buckle (1) for fixing at least one band (2), the buckle (1) having at least one buckle main part (3) and at least one clamping web (5) which is mounted on the buckle main part (3) in a movable manner in at least one movement direction (4) in order to clamp the band (2) that is guided around the clamping web (5). The clamping web (5) has at least one clamping web main part (6) that is mounted on the buckle main part (3) in a movable manner and a clamping leg (7) that projects beyond the clamping web main part (6) in order to contact the band (2) that is guided around the clamping web (5).

17 Claims, 3 Drawing Sheets

(56) References Cited

U.S. PATENT DOCUMENTS

| | | | |
|---|---|---|---|
| 7,712,191 | B2 | 5/2010 | Huang |
| 2004/0158955 | A1 | 8/2004 | Acton et al. |
| 2010/0122437 | A1 | 5/2010 | Hortnagl |
| 2011/0209314 | A1 | 9/2011 | Miller |
| 2013/0326848 | A1 | 12/2013 | Strahl |

FOREIGN PATENT DOCUMENTS

| | | | | |
|---|---|---|---|---|
| AU | 4661472 | A1 | 3/1974 | |
| DE | 1992277 | | 8/1968 | |
| DE | 1557477 | | 4/1970 | |
| DE | 82300 | | 5/1971 | |
| DE | 2115471 | | 2/1972 | |
| DE | 2245343 | * | 3/1973 | ..... B65B 13/22 |
| DE | 2419160 | | 10/1975 | |
| DE | 2552993 | | 6/1977 | |
| DE | 2928028 | | 1/1981 | |
| DE | 8213354 | | 9/1982 | |
| DE | 3346755 | | 7/1985 | |
| DE | 19712582 | | 10/1998 | |
| DE | 19829899 | | 5/1999 | |
| DE | 10119469 | | 11/2002 | |
| DE | 69812862 | | 1/2004 | |
| EP | 0043198 | | 1/1982 | |
| EP | 0111831 | | 6/1984 | |
| EP | 0925734 | | 4/2003 | |
| FR | 2556421 | | 6/1985 | |
| GB | 1066740 | | 4/1967 | |
| GB | 2244079 | | 11/1991 | |
| GB | 2295198 | | 5/1996 | |
| WO | 9961209 | | 12/1999 | |
| WO | 0035711 | | 6/2000 | |
| WO | 0037511 | | 6/2000 | |

* cited by examiner

BUCKLE

BACKGROUND

The present invention relates to a buckle for fastening at least one band, wherein the buckle has at least one buckle main body and at least one clamping web, which is shiftably mounted in at least one shifting direction on the buckle main body, for clamping the band which is guided around the clamping web.

Buckles of the generic type are known in the prior art from, for example, AT 506 290 B1. These may be one-piece buckles, with two bands, which mostly lie opposite one another, being fastened to the buckle main body of said buckles. They may, however, also be buckles consisting of two or a plurality of parts, in which two or a plurality of buckle components are detachably interlockable with one another, a band being fastenable to at least one or each buckle component or its buckle main body. The shiftably mounted clamping web makes it possible, by moving the clamping web, to clamp the band which is guided around it. In order to release this clamping connection, the web is moved in the opposite direction, and as a result the band may be adjusted or completely removed. In the clamping position, the connection between band and buckle main body should absorb tensile forces which are as high as possible, without the band being removed from the buckle main body or being damaged in the process. On the other hand, adjustment of the band, if required, should be as easy as possible.

SUMMARY

It is the object of the invention to improve a buckle of the generic type with a view to avoiding any slippage of the band even at high tensile forces.

According to the invention this is achieved in that the clamping web has at least one clamping web main body which is shiftably mounted on the buckle main body, and a clamping leg which protrudes beyond the clamping web main body for the abutment of the band which is guided around the clamping web.

Through the use of the clamping leg which protrudes beyond the clamping web basic body, preferably parallel to the direction of movement, the contact surface area of the band on the clamping web is increased. As a result, the retention forces are increased. Furthermore, the band which is under tension may transmit a higher torque onto the clamping web via the clamping leg, thereby additionally reinforcing the clamping action. As a result, the connection consisting of band and buckle can absorb substantially higher tensile forces, without the connection being adjusted or released by the band slipping out and without the band being cut off in the process. Buckles according to the invention may be used for fastening and/or connecting a great variety of bands or straps. These may be one-piece buckles which have only a single buckle main body. They may, however, also be multi-part buckles having a plurality of buckle components which are connectable to one another in a manner known, wherein different straps or bands may be fastened to the buckle main bodies of the buckle components. Buckles according to the invention may be configured, for example, for fastening at least one band to a body or an object and/or for fastening or connecting at least two bands to one another. The clamping leg is favorably movable together with the clamping web main body.

Preferred embodiments of the invention provide that the clamping leg, preferably the entire clamping web, is pivotable about a pivot axis which is preferably orthogonal to the direction of movement. Due to the pivotability provided in addition to the movability of the clamping leg or the entire clamping web, the band which abuts the clamping leg may generate particularly high torque in the clamping position of the clamping web, such that a particularly strong connection between band, clamping web and buckle main body is achieved. In order to further increase the contact surface area and thus to absorb particularly high tensile forces, a preferred embodiment of the invention provides that that surface of the clamping web that faces the band which is guided around the clamping web and/or the optionally provided opposing web has at least regionally a succession of elevations and depressions for increasing the contact surface area. The dimensioning or size and the space between elevations and depressions may be implemented in very different ways. In the case of a multiplicity of very small elevations and depressions, one could also refer to a roughened surface.

Preferred embodiments provide that the entire clamping web is formed in one piece. This means that all components which form the clamping web are connected to one another as a single piece. This relates, in particular, to the clamping web main body and the clamping leg and the optionally provided release lug which is explained further below.

BRIEF DESCRIPTION OF THE DRAWINGS

Further features and details of preferred embodiments of the invention are explained with reference to the following description of the figures, in which.

DETAILED DESCRIPTION OF THE PREFERRED EMBODIMENTS

Figure 1:
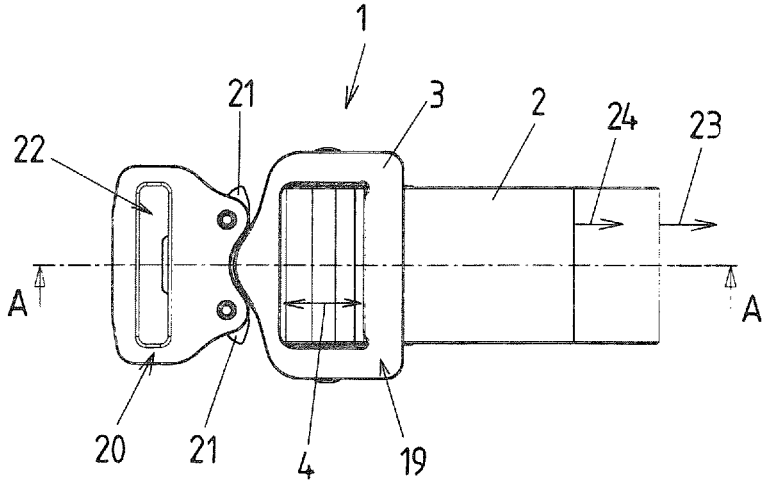
FIGS. 1 to 8 are illustrations relating to a first exemplary embodiment according to the invention.

FIG. 1 shows a plan view of a buckle 1 according to the invention which is formed in two parts. The buckle component 19 is a male component which may be inserted into the female buckle component 20. In the position which is illustrated in FIG. 1, the operating levers 21 interlock the buckle components 19 and 20 with one another. Upon manually activating or pivoting the operating levers 21, the male buckle component 19 may be extracted from the female buckle component 20. The female buckle component 20 has a simple opening 22, through which a further strap 2, which is not illustrated here, may be guided. The basic construction described hitherto of the buckle 1 is known per se and thus does not require further elaboration at this point.

Figure 2:
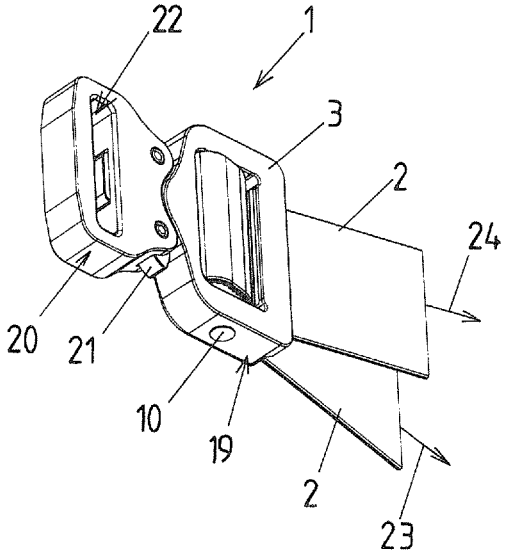
Figure 5:
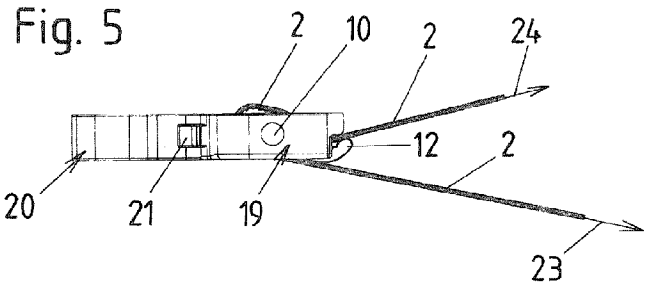
Figure 6:
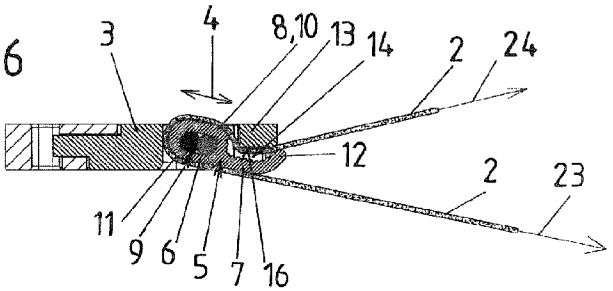
Figure 8:
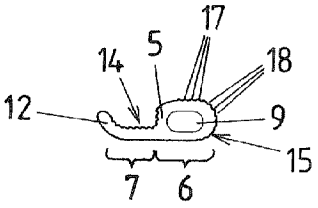
Figure 3:
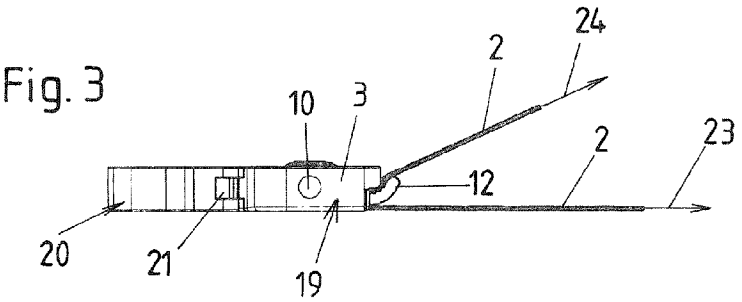
Figure 4:
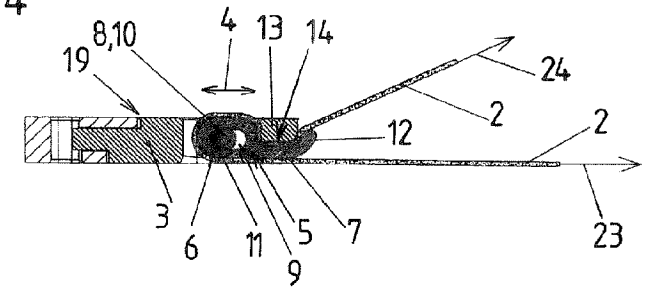
Figure 7:
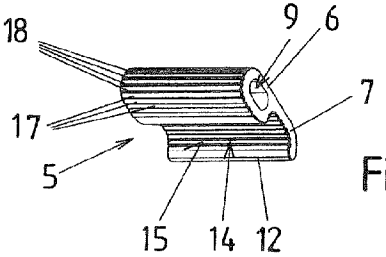

The male buckle component 19 in this exemplary embodiment has the buckle main body 3, to which the band 2 which is actually illustrated in FIG. 1 may be fastened once it has been guided around the clamping web 5. In the case of corresponding tension in the direction 23, the clamping web 5, together with the band 2 which is guided around it, is pressed against the buckle main body 3, such that clamping of the band occurs between the buckle main body 3 and the clamping web 5. FIG. 2 shows a perspective illustration of said buckle 1 together with strap or band 2. FIG. 3 shows a lateral view of the buckle 1 according to FIGS. 1 and 2 in the clamping position, in which the band 2 is retained on the buckle main body 3 in a clamping manner. FIG. 5 shows a corresponding lateral view in which, however, the clamping web 5 is in an opened position which enables the band 2 to be adjusted and/or removed. FIG. 4 shows a longitudinal section which is parallel to the shifting direction 4 along the section line AA which is illustrated in FIG. 1. The corresponding sectional plane is placed in a normal orientation on the page surface according to FIG. 1. FIG. 4 shows the longitudinal section in the clamping position according to FIG. 3. FIG. 6 shows an analogous longitudinal section in the opened position according to FIG. 5. FIG. 7 shows a perspective illustration of the clamping web 5 used. FIG. 8 shows a longitudinal section through said clamping web 5 in the same sectional plane as in FIGS. 4 and 6, that is to say as a longitudinal section which is parallel to the shifting direction 4. The fundamental construction of the clamping web 5 configured according to the invention can be seen particularly well in FIG. 8. The clamping web 5 has a clamping web main body 6 and a clamping leg 7 which protrudes beyond the clamping web main body 6. In order to provide for the shiftability of the clamping web 5 in relation to the buckle main body 3, the clamping web main body 6 of this exemplary embodiment has, when viewed in the longitudinal section which is parallel to the shifting direction 4, a slotted hole-type recess 9, through which a support pin 10, which is fixedly located on the buckle main body 3, is inserted. At that end of the clamping leg 7 that faces away from the clamping web main body 6, the clamping web 5 has a release lug 12 which is preferably angled towards the clamping leg 7. As can be seen particularly well in FIG. 8, the clamping web 5, when viewed in the longitudinal section which is parallel to the shifting direction 4, has at least approximately the shape of a figure nine or six.

In order to further increase the contact surface area between band 2 and clamping web 5, a succession of elevations 17 and depressions 18 are located at least regionally on the surface 15 of the clamping web 5, said surface being assigned to the band 2. The elevations 17 and depressions 18 may be formed, for example, as a succession of webs and grooves, but also in the shape of a corresponding field of pimples or suchlike. The dimensioning of the elevations 17 and depressions 18 may also be configured in a great variety of manners.

The clamping web 5 of this exemplary embodiment has, when viewed in a longitudinal section which is parallel to the shifting direction 4, a U-shaped recess 14, into which an opposing web 13, which is preferably fixedly located on the main buckle body 3, is insertable, with the band 2 which is guided around the clamping web 5 being placed in between. The U-shaped recess 14, when viewed in the longitudinal section which is parallel to the shifting direction 4, of this exemplary embodiment is delimited by the clamping web main body 6 and the clamping leg 7 and the release lug 12. The recess 14, when viewed in the longitudinal section which is parallel to the shifting direction 4, may of course also have a different cross-sectional shape which deviates from the U-shape.

The further construction and operation of this exemplary embodiment can be seen particularly well when comparing FIGS. 4 and 6. As mentioned, FIG. 4 shows the clamping position in which the band 2 is retained in a clamping manner by means of the clamping web 5 according to the invention. FIG. 6 shows the opened position in which the band 2 may be moved on the clamping web 5 or removed from it by pulling in one of the directions 23 or 24.

The support pin 10, which in this case is fixedly located on the buckle main body 3, is inserted through the slotted hole-type recess 9 of the clamping web 5. As a result of the cross section of this recess 9 being in the shape of a slotted hole, the clamping web 5 or its clamping web main body 6 are movable in relation to the support pin 10 or the buckle main body 3 in the directions of movement 4. In preferred embodiments, such as those illustrated in FIGS. 1 to 8, the support pin 10 simultaneously forms the pivot axle 8 about which the clamping web 5 together with the clamping leg 7 may be pivoted. The support pin 10 may be configured in a great variety of manners and may, therefore, also generally be referred to as a support element.

Preferred embodiments of the invention, such as those shown here, further provide that, in addition to the support pin 10, an elastic spring element 11 is located in the slotted hole-type recess 9, preferably on that side of the clamping web main body 6 that faces away from the clamping leg. The elastic spring element 11 may be configured in a great variety of manners; it may, for example, be an elastomer element.

When, starting from the opened position according to FIG. 6, tension is applied on this part of the band 2 in the direction 23, the clamping leg 7 or the entire clamping web 5 is pivoted about the pivot axle 8 and simultaneously moved in the direction 23. In this event, compression of the elastic spring element 11 occurs and the opposing web 13 of the buckle main body 3 is inserted into the U-shaped recess 14, when viewed in the longitudinal section which is parallel to the shifting direction 4, of the clamping web 5, with the band 2 being placed in between. As a result of tension in the direction 23, a very high torque is applied by the band 2 via the clamping leg 7 on the clamping web 5, such that very high retention forces are generated. The ribbing or the increased contact surface area as a result of the elevations 17 and depressions 18 additionally reinforces the retention forces. In comparison with the clamping webs 5 which are known per se from the prior art, the transmission of force or the absorbable tensile forces are increased by a double-digit percentage without any slippage of or damage to the band or the strap 2 occurring.

In order for the buckle 1 to be changed from the clamping position according to FIG. 4 to the opened position according to FIG. 6, it is sufficient to pull at the corresponding side of the band in the direction 24, the release lug 12 then causing the entire clamping web 5 to be pivoted about the pivot axle 8 and to be moved by the elastic spring element 11 in one of the shifting directions 4 into the position according to FIG. 6. The elastic spring element 11 leads to a limitation of travel for the displacement movement.

Figure 9:
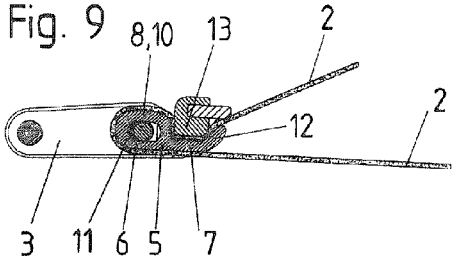
FIGS. 9 to 16 are examples of further embodiments according to the invention of a buckle.
Figure 10:
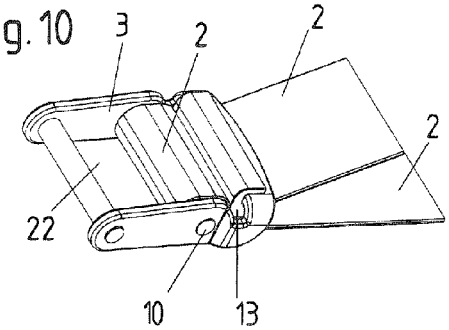
Figure 11:
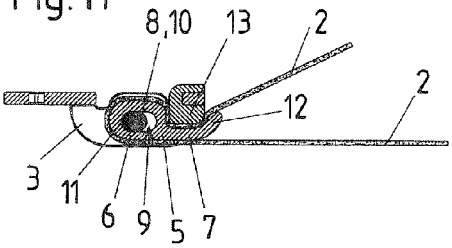
Figure 12:
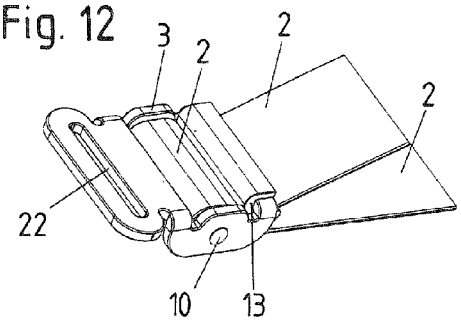
Figure 13:
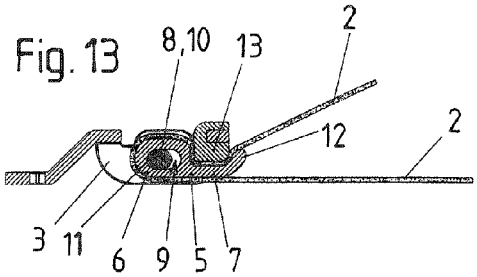
Figure 14:
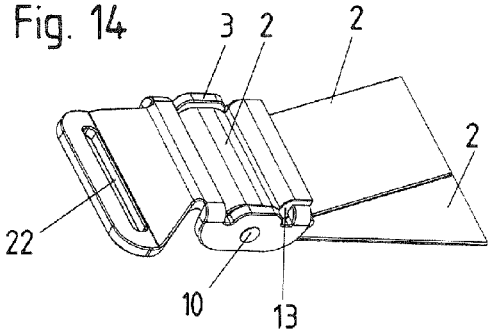
Figure 15:
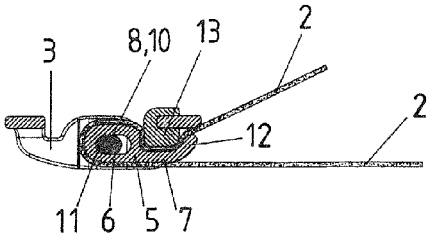
Figure 16:
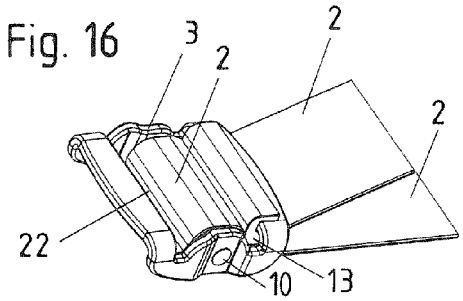

FIGS. 9 to 16 show by way of example alternative embodiments of the invention. In FIGS. 9, 11, 13 and 15, longitudinal sections which are analogous to FIG. 4 are shown in each case. FIGS. 10, 12, 14 and 16 in each case show the corresponding perspective illustrations viewed from the exterior. FIGS. 9 and 10 form a first alternative exemplary embodiment, FIGS. 11 and 12 a second alternative exemplary embodiment, FIGS. 13 and 14 a third alternative exemplary embodiment, and FIGS. 15 and 16 a fourth alternative exemplary embodiment.

The operation of the clamping web 5 in its embodiment according to the invention corresponds in all these alternative exemplary embodiments to the operation of the first exemplary embodiment. Thus, it does not require another separate explanation. FIGS. 9 to 16 are substantially intended to show that buckles 1 according to the invention or their buckle main bodies 3 can be configured very differently. The buckles 1 may, for example, be provided as one-piece buckles such that a second band 2 is guided directly through the opening 22 and fastened there. It may, however, also be provided that the buckle main bodies 3 are in each case part of a first buckle component 19 which can be detachably connected or interlocked via a corresponding fastening or locking mechanism with further buckle components 20, which are not illustrated here, of the corresponding buckle 1.

LIST OF REFERENCE SIGNS

1 Buckle
2 Band
3 Buckle main body
4 Shifting Direction
5 Clamping web
6 Clamping web main body
7 Clamping leg
8 Pivot axle
9 Slotted hole-type recess
10 Support pin
11 Elastic spring element
12 Release lug
13 Opposing web
14 Recess
15 Surface
16 Surface
17 Elevation
18 Depression
19 Buckle component
20 Buckle component
21 Operating lever
22 Opening
23 Direction
24 Direction

The invention claimed is:

1. A buckle for fastening at least one band, the buckle comprising a buckle main body and a clamping web, which is shiftably mounted on the buckle main body for linear movement in at least one shifting direction relative to the buckle main body, for clamping the band which is guided around the clamping web, the clamping web has at least one clamping web main body by which the clamping web is shiftably mounted on the buckle main body, and a clamping leg which protrudes beyond the clamping web main body for abutment of the band which is guided around the clamping web, wherein in order to provide for the shiftability of the clamping web in relation to the buckle main body, the clamping web main body has, when viewed in a longitudinal section which is parallel to the shifting direction, an elongated hole-type recess that extends in the shifting direction through which a support pin which is located on the buckle main body is inserted.

2. The buckle as claimed in claim 1, wherein the support pin is fixed on the buckle main body.

3. The buckle as claimed in claim 1, wherein the entire clamping web (5) is formed in one piece.

4. The buckle as claimed in claim 1, wherein the clamping leg is pivotable about a pivot axle.

5. The buckle as claimed in claim 4, wherein the pivot axle is orthogonal to the direction of movement.

6. The buckle as claimed in claim 1, wherein the support pin forms a pivot axle for the clamping leg.

7. The buckle as claimed in claim 1, wherein in addition to the support pin, an elastic spring element is located in the slotted hole-type recess.

8. The buckle as claimed in claim 7, wherein the elastic spring element is located in the slotted hole-type recess on a side of the support pin that faces away from the clamping leg.

9. The buckle as claimed in claim 1, wherein the clamping web has a release lug at an end of the clamping leg that faces away from the clamping web main body.

10. The buckle as claimed in claim 1, wherein the buckle has an opposing web which is located on the buckle main body, the opposing web is insertable into a recess of the clamping web with the band which is guided around the clamping web being placed between the opposing web and the recess of the clamping web.

11. The buckle according to claim 10, wherein the recess of the clamping web is delimited by the clamping web main body and the clamping leg and the release lug of said web.

12. The buckle as claimed in claim 10, wherein said recess is U-shaped when viewed in a longitudinal section which is parallel to the shifting direction.

13. The buckle as claimed in claim 10, wherein a surface of at least one of the clamping web that faces the band which is guided around the clamping web or the opposing web has at least regionally a succession of elevations and depressions for increasing a contact surface area.

14. The buckle as claimed in claim 1, a surface of the clamping web that faces the band which is guided around the clamping web has at least regionally a succession of elevations and depressions for increasing a contact surface area.

15. The buckle as claimed in claim 1, wherein the clamping web, when viewed in a longitudinal section which is parallel to the shifting direction, has at least approximately the shape of a figure nine.

16. The buckle as claimed in claim 1, wherein the entire clamping web is pivotable about a pivot axle.

17. A buckle for fastening at least one band, the buckle comprising at least one buckle main body and at least one clamping web, which is shiftably mounted in at least one shifting direction on the buckle main body, for clamping the band which is guided around the clamping web, the clamping web has at least one clamping web main body which is shiftably mounted on the buckle main body, and a clamping leg which protrudes beyond the clamping web main body for abutment of the band which is guided around the clamping web, the clamping web has a release lug at an end of the clamping leg that faces away from the clamping web main body, and said release lug is angled towards the clamping leg.

* * * * *